US008356877B2

(12) United States Patent
Lebron et al.

(10) Patent No.: US 8,356,877 B2
(45) Date of Patent: Jan. 22, 2013

(54) VERIFYING A MAINTENANCE PROCESS ON A PRINT HEAD

(75) Inventors: Hector Jose Lebron, San Diego, CA (US); Anders T. Peterson, Camas, WA (US); Joshua Joel Cantrell, Hillsboro, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 177 days.

(21) Appl. No.: 13/055,739

(22) PCT Filed: Aug. 11, 2008

(86) PCT No.: PCT/US2008/072798

§ 371 (c)(1), (2), (4) Date: Jan. 25, 2011

(87) PCT Pub. No.: WO2010/019132

PCT Pub. Date: Feb. 18, 2010

(65) Prior Publication Data

US 2011/0122186 A1 May 26, 2011

(51) Int. Cl.
*B41J 29/393* (2006.01)

(52) U.S. Cl. ..... 347/19

(58) Field of Classification Search ..... 347/19, 347/22, 23

See application file for complete search history.

(56) References Cited

U.S. PATENT DOCUMENTS

| | | | |
|---|---|---|---|
| 5,121,130 | A | 6/1992 | Hempel et al. |
| 6,460,964 | B2 | 10/2002 | Osborne |
| 6,655,774 | B2 | 10/2002 | Ama |
| 6,752,493 | B2 | 6/2004 | Dowell et al. |

*Primary Examiner* — Julian Huggman

(57) ABSTRACT

The present invention is embodied in a printing system (100) that includes a print head (120) having a controller (110), a temperature sensor (116) and a priming system (126) configured to apply a fluid pressure externally to the print head (120) to purge the print head with fluid, wherein purging the print head (120) with fluid has an effect of reducing the print head temperature. The controller (110) is configured to activate the priming system (126) for purging the printhead (120) with fluid, monitor a signal from the temperature sensor (406), and determine (418) whether activating the primer has resulted in sufficient fluid passing through the print head (120) based upon monitoring the signal from the temperature sensor (116).

15 Claims, 5 Drawing Sheets

VERIFYING A MAINTENANCE PROCESS ON A PRINT HEAD

BACKGROUND

Inkjet print heads usually require some form of fluid purging or priming during their operation and/or their manufacture. Priming can also be useful as a servicing tool by service technicians as well as end users, and also during the printers own self-diagnosis process. Priming is the process of moving ink from the ink reservoir, though the passageways leading to the orifices, and through the orifices. Priming moves the ink into place so that printing can begin. Priming can also be as a print head cleaning mechanism by flushing clean ink through the print head. Over time Inkjet print heads can develop unwanted obstructions in the ink path, the orifices, the nozzle plate or any other area in the pathway the ink travels on its way to the orifices for ejection. Dried out ink is a major cause of obstructions within an Inkjet print head. Obstructions in the ink path usually result in parts of the printed output missing, such as white lines being visible through printed black text.

Printer manufacturers have devised various means for priming an Inkjet print head. Usually the process involves moving the print head to a priming station located at one of the extreme ends of it side-to-side travel. Once docked in the priming station the process of priming begins and involves some method of moving the ink through the print head.

SUMMARY

The present invention is embodied in a printing system that includes a print head having a controller, a temperature sensor and a priming system configured to apply a fluid pressure externally to the print head to purge the print head with fluid, wherein purging the print head with fluid has an effect of reducing the print head temperature. The controller is configured to activate the priming system for purging the printhead with fluid, monitor a signal from the temperature sensor, and determine whether activating the primer has resulted in sufficient fluid passing through the print head based upon monitoring the signal from the temperature sensor.

DETAILED DESCRIPTION OF PREFERRED EMBODIMENT

In the following description, reference is made to the accompanying drawings, which form a part hereof, and in which is shown by way of illustration a specific example in which the invention may be practiced. It is to be understood that other embodiments may be utilized and structural changes may be made without departing from the scope of the present invention.

Figure 1:
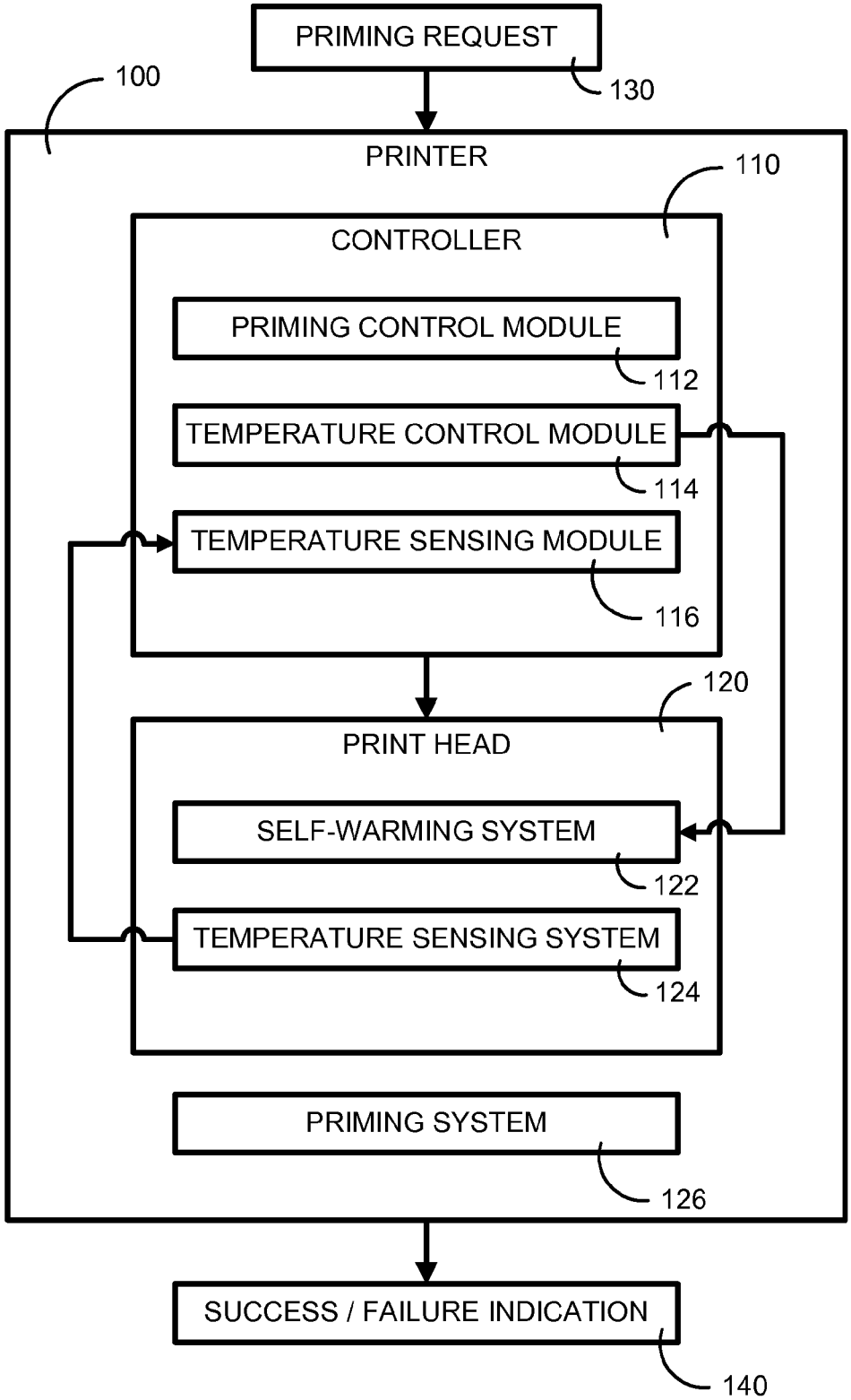
FIG. 1 is a block diagram showing one embodiment of the present invention.

FIG. 1 is a block diagram showing one embodiment of the present invention. One embodiment of the present invention is a printing system or printer 100 that includes a controller 110, print head 120, and a priming system 126. The controller 110 is a logic component of the printer 100, which can be implemented as a microprocessor with input and output control capabilities, or some other logic circuitry. The controller 110 includes a priming control module 112, a temperature control module 114 and a temperature sensing module 116. In one embodiment, the controller 110 is implemented as a microprocessor interface to a computer readable memory having input and output capabilities. In this embodiment, the computer readable memory is configured to execute instructions on the controller 110 for verifying proper operation of a maintenance priming operation of print head 120.

The print head 120 includes nozzles (see FIGS. 3A and 3B), a self-warming system 122, and a temperature sensing system 124. The priming system 126 is configured to apply a fluid prime pressure external to the print head 120 to purge the print head 120 with fluid. External to the print head 120 refers to the fact that the fluid prime pressure is not generated from within the print head 120 but is generated by a component of printer 100 that is separate from the print head 120. The effect of purging the print head 120 with fluid is to reduce the temperature of the print head 120 by convective cooling of purged fluid passing through the print head 120. This is in contrast to operating print head nozzles that has an effect of raising a print head 120 temperature.

Priming control module 112 works in conjunction with priming system 126. The priming control module 112 is responsible for initiating a priming event, as well as monitoring its progress and determining if the priming event was successful. Priming system 126 performs the physical task of priming or fluid purging the print head 120. Also, the controller 110 is configured to receive or monitor the signal from the temperature sensing module 116 and determine whether the priming system 126 has properly passed fluid through the print head 120 based upon an analysis of the signal from the temperature sensing module 116. In the discussion that follows, maintenance operations include priming or a priming event, fluid purging, and passing fluid through the print head 120 because the same pressure source can be used to prime the print head 120 or to fluidically purge the print head 120.

In general, in one embodiment of the present invention, the priming process is initiated upon printer 100 receiving the priming request 130. The priming request 130 can be initiated in several different ways, including through a user-interface on the printer 100 itself, such as a button or through software or firmware commands issued electronically by the printer 100 or a computer connected to the printer 100. Upon receiving the priming request 130, controller 110 utilizes priming control module 112, temperature control module 114 and temperature sensing module 116 to initiate, and monitor a priming event. When the priming event completes, the success or failure is indicated 140. The indication can be conveyed multiple ways including through a user-interface on the printer 100 itself, such as and indicator light, or through an electronic command sent to a computer connected to the printer 100. The priming process with success or failure detection is explained in more detail in FIG. 4.

Temperature control module 114 drives self-warming system 122 located in the print head 120. The temperature control module 114 is responsible for warming the print head 120 as required and works in conjunction with temperature sensing system 124 to allow the temperature of the print head 120 to be precisely controlled. As the print head 120 is warmed by the self-warming system 122, temperature sensing system 124 allows the temperature to be fed back to temperature sensing module 116, and used as a signal to halt further warming once the desired temperature has been reached.

In one embodiment, the controller 110 activates the self-warming system 122 and raises the temperature of the print head 120 to an elevated temperature. The controller 110 also monitors the temperature of the print head 120 as it cools from the elevated temperature to a reduced temperature to determine whether fluid is being sufficiently or properly passed through the print head 120. If fluid is being properly passed through the print head 120, the temperature will fall more rapidly than if the fluid is not passing through the print head 120. The analysis of the signal from the temperature sensing module 116 thereby determines whether the fluid is properly passing through the print head 120. A success or fail indication 140 may then be provided that is indicative of whether a sufficient fluid purge of the print head has taken place.

In one embodiment, the controller monitors the signal from the temperature sensing module 116 when no fluid is being passed through the print head 120 for calibration purposes. From this, the controller 110 can determine a temperature change when fluid is not passing through the print head 120. When no fluid is being passed, the controller 110 also monitors the temperature of the print head 120 during maintenance operations of the priming system 126. The controller 110 determines a temperature change during maintenance operations of the priming system 126. In all cases, the controller 110 compares the temperature changes to determine if fluid flow is properly passing through (and thereby convectively cooling) the print head 120 during the maintenance operations.

The analysis of the temperature change can operate in various ways within the scope of the invention. In one embodiment, the analysis determines the temperature drop or temperature difference between two points in time. In another embodiment, the analysis determines a rate change of temperature at one or more points in time. In another embodiment, the analysis determines a time during which a certain temperature drop takes place. The analysis can further include a comparison of the cases of (1) no fluid flow and (2) maintenance process for any of these embodiments.

In one embodiment, the print head 120 is affixed to a print cartridge (not shown in FIG. 1) The maintenance operation is performed by using the priming system 126 to apply a fluid pressure external to print head 120. The print head 120 can includes a plurality of drop ejecting nozzles coupled to an internal fluid chamber. In one embodiment, the maintenance priming system 126 is a negative pressure or vacuum source configured to be applied to the nozzles thereby causing fluid to pass through the print head 120 and out of the nozzles. In another embodiment, the maintenance priming system 126 is configured to apply a positive pressure to the print cartridge causing the fluid to pass from the internal fluid chamber and out of the nozzles.

In one embodiment, the print head 120 is warmed to a test elevated temperature, activating a pressure source to pass fluid through the print head 120, receiving a test signal indicative of a temperature of the print head 120 as it cools from the test elevated temperature while the pressure source is applied, and analyzing the test signal to thereby determines whether the fluid properly passed through the print head 120. This procedure can include a method for calibrating the signal.

One calibration method may include warming the print head 120 up to a calibration elevated temperature and receiving a calibration signal indicative of a temperature of the print head 120 as it cools from the calibration elevated temperature while the pressure source is not applied (when it is known that fluid is not flowing through the print head 120). With this method of calibration, analyzing the test signal also includes analyzing the calibration signal in order to draw a comparison between cooling with and without the application of the priming system 126.

In one embodiment, the test signal and the test elevated temperature operate during the application of a maintenance operation and the calibration operates when the maintenance operation is not taking place. Comparative analysis can be used to determine substantial differences for the test. In other words, more cooling and a greater magnitude temperature drop can occur when the maintenance operation is properly performed and the print head 120 is successfully purged with fluid.

Figure 2:
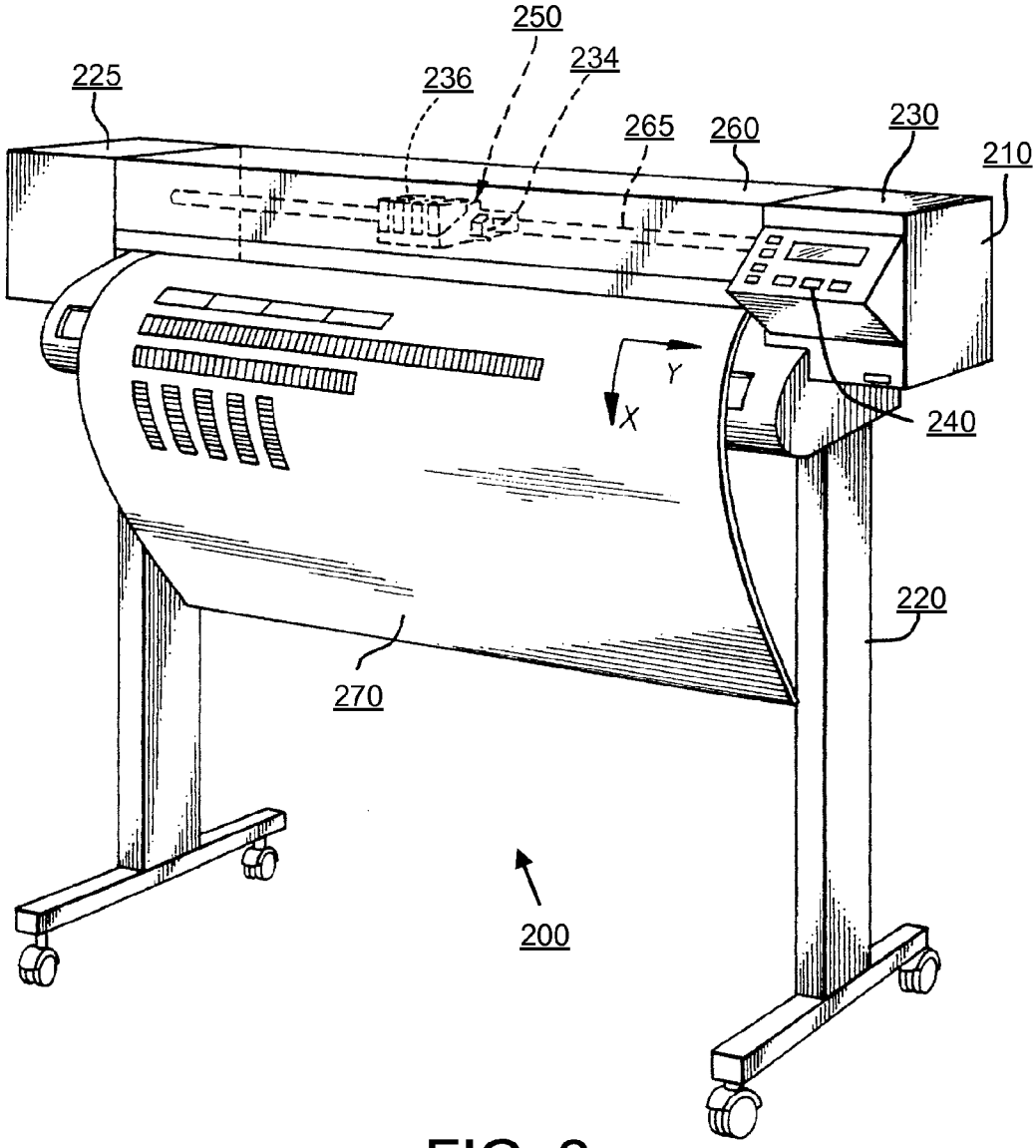
FIG. 2 is one embodiment of an exemplary printer that incorporates the invention and is shown for illustrative purposes only.

FIG. 2 is a perspective view depicting a large format printing system 200 that incorporates the present invention. Printing system 200 is configured to print on media 270 utilizing print cartridges 236 that are mounted within a scanning carriage 250. Scanning carriage 250 moves or scans along a carriage transport path 265 parallel to a scan axis Y under control of controller 110 (FIG. 1). Printer 200 transports media along media transport axis X that is perpendicular to scan axis Y under control of controller 110.

Figures 3A, 3B:
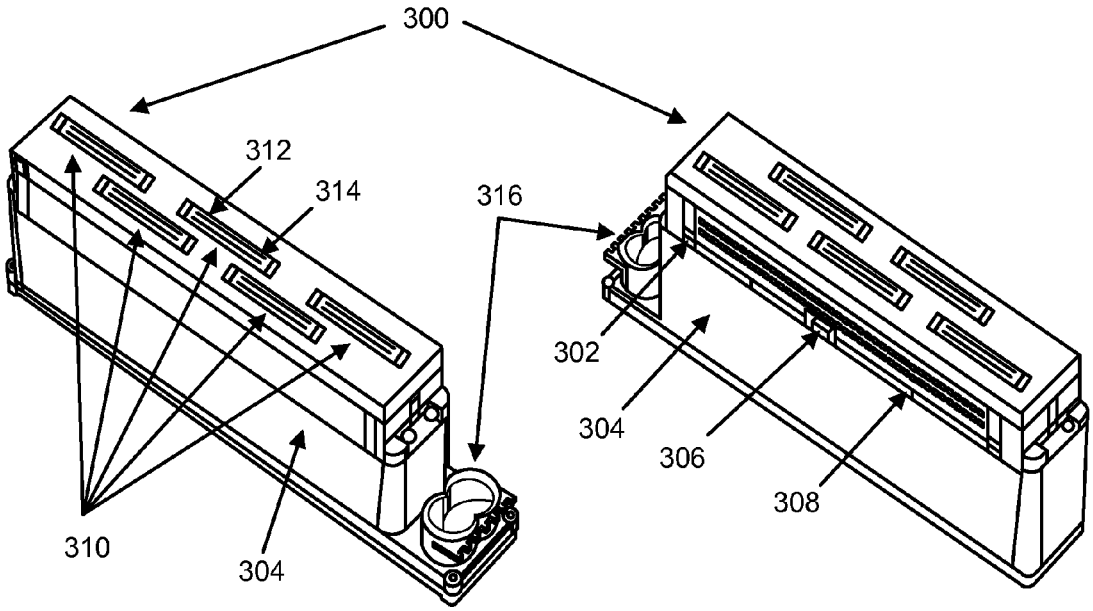
FIGS. 3A and 3B are perspective views shown for illustrative purposes only of an embodiment of an exemplary print cartridge incorporating the present invention.

Each of cartridges 236 includes a print head 120 (FIG. 1) that includes an array of nozzles (depicted with respect to FIGS. 3A and 3B). By providing motion in the X and Y directions for the print heads 120 relative to the media 270, the controller 110 enables print heads 120 to selectively print upon at least a majority of an area of media 270.

Printing system 200 also includes a service station 230 that is positioned under a cover 210. Service station 230 includes priming system 126. Controller 110 is configured to position carriage 250 proximate to the service station 230 when a priming event is to take place so that priming system 126 can properly engage print head 120 or a portion of cartridge 236 to enable priming system 126 to seal to print head 120 or cartridge 236 so that priming system 126 can properly provide a fluid purge of print head 120.

Printing system 200 includes control panel or user interface 240 that is configured to provide control signals to controller 110 based upon inputs from a user or operator of printing system 200 to the control panel 240. Control panel 240 may be positioned at the same end of the printer as service station 230 relative to scan axis Y. Optionally or alternatively, a service station 225 may be positioned at an end of printing system 200 that is spaced apart from control panel 240 relative to the scan axis Y. As a note carriage 250 may include an encoder 234 configured to read an encoder strip (not shown) that is disposed along carriage transport path 265 in order to provide a better positional accuracy of carriage 250 along transport axis Y.

Other elements of printing system 200 such as support stand 220 are not discussed since they are known in related art describing printing systems. Although the present invention is described with respect to a large format printing system 200 it is to be understood that the present invention applies to any ink jet printing system utilizing a priming system 126 used to purge a print head 120 including piezo and thermal ink jet systems, drum printers and commercial inkjet printers to name a few.

FIGS. 3A and 3B show for illustrative purposes perspective views of an exemplary inkjet cartridge 300 (depicted as element 236 in FIG. 2) of one embodiment, including an example of the print head assembly 120 of FIG. 1, used in the printer 200 of FIG. 2. However, the printing system 100 of FIG. 1 may be incorporated in any print head and printer configuration, as mentioned above. The illustrated cartridge 300 includes a thermal inkjet print head assembly 302 supported by a body 304 which defines a small ink reservoir or fluid chamber therein. The print head assembly 302 includes five print heads 120. The body 304 has several alignment datums, such as datum 306, which may be aligned with conventional datums (not shown) of carriage 234 of FIG. 2 when cartridge 300 is installed. The cartridge 300 also includes a group of electrical interconnect pads 308 which may be coupled with conventional electrical interconnects (not shown) of carriage 234 of FIG. 2 when cartridge 300 is installed for communication between the print head 302 and controller 110 of FIG. 1.

The print head assembly 302 includes an orifice plate 310, which defines a series of ink ejecting nozzles, illustrated in FIGS. 3A and 3B, as being arranged in two linear arrays 312 and 314 which may be constructed by, for example, laser ablation. The term "linear" is used generally with respect to arrays 312, 314 because in some embodiments, the nozzles may be arranged in a slightly offset or staggered pattern, while in other implementations other nozzle arrangements may be more suitable. Ink is received from the off axis stationary reservoirs and delivered via flexible to tubing to an ink inlet port, indicated generally at item number 316 in FIGS. 3A and 3B, and is stored within the reservoir defined by body 304 prior to ejection from the nozzles of arrays 312, 314. An on board integrated circuit chip (not shown) may provide feedback to the printer 200 of FIG. 2 regarding certain parameters of the print head assembly 300, including information from the substrate temperature sensor system 124 of FIG. 1.

Figure 4:
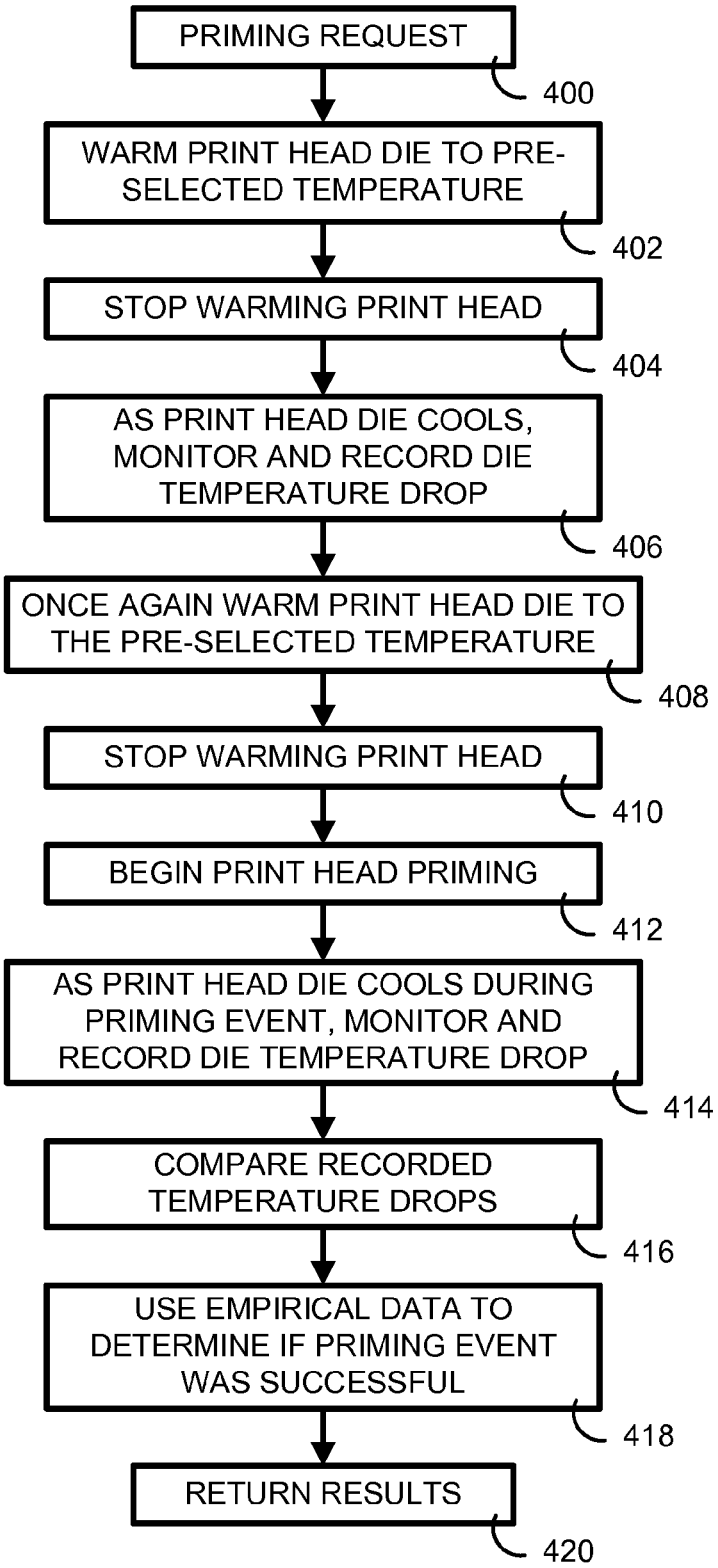
FIG. 4 is a flow diagram describing one embodiment of the present invention.

FIG. 4 is a flow diagram which depicts an exemplary process of a print head fluid purging or priming procedure, which incorporates a method of detecting whether or not the priming event was successful, in one embodiment of the present invention. The process of priming the print head begins upon the reception of a priming request, by the print engine (step 400). This request could be initiated by a user or technician through a user-interface on the printer itself, e.g. buttons or keys, or the request could come from a computer which directly communicates with the printer. Alternatively this request may be automatically generated within a printing system or between a printing system and a computer. Upon receiving this request, the print engine begins actively warming the print head 120 using the print head's thermal control circuitry 122 to a pre-selected high temperature value (step 402). The print head thermal control circuitry 122 allows the print head 120 to be actively warmed as well as monitoring the print head 120 temperature. Once the print head thermal control circuitry 122 has determined that the print head has reached the desired temperature, the self-warming system 122 stops actively warming the print head 120 (step 404).

As the print head die cools down, the print engine monitors and records the temperature drop of the print head as a function of time (T-Drop NO PRIME) (step 406). The period of time lapse (delta) for which to record the temperature drop would be a function of, among other things, the targeted high temperature point, the amount of ink primed, and the time taken for a given prime event. These values can be optimized for the specific purpose of using a prime event to monitor system health.

After recording the temperature drop, once again the print engine begins actively warming the print head 120 to the pre-selected high temperature value (step 408). Once again, when the die reaches the pre-selected high temperature value, the print engine stops actively warming the print head (step 410). At the moment the print engine stops warming the print head 120, a priming process is initiated (step 412). As described above, the priming process is the process of moving ink through the print head 120. Again, as the print head 120 cools down, controller 110 monitors and records the temperature drop of the die as a function of time (T-Drop WITH PRIME) (step 414). Note that during this temperature drop, a priming event is in progress and ink is actively moving through the print head.

The print engine compares the T-Drop NO PRIME with T-Drop WITH PRIME (step 416). Using this information, the print engine determines the success or failure of the priming event (step 418). In one embodiment, a healthy prime event will yield a larger print head die temperature drop (~10-15° C.) if compared with the temperature drop for the same time-lapse with no ink priming. The results of the prime event are returned (step 420). The results can be communicated back to the user, or technician either through a user-interface on the printer itself, e.g. Liquid Crystal Display (LCD) or pattern of Light Emitting Diodes (LEDS), or by communicating the results back to the computer that issued the priming request.

As described above, a priming event according to one embodiment of the present invention includes the purging of print head 120 by priming system 126. Just prior to the priming event, carriage 250 is moved along carriage transport path 236 to service station 230 under control of controller 110. During the priming event carriage 250 is "parked" proximate to service station 230.

During the priming event priming system 126 applies a pressure external to print head 120 and thereby purges a volume of fluid through substantially all of the nozzles of print head 120 simultaneously. This is done either by applying a vacuum over the nozzles or by applying a positive pressure to a portion of cartridge 236 (or cartridge 300).

In one embodiment, priming system 126 applies a pressure pulse to print head 120 that purges at least 0.5 milliliters of ink through print head 120. In another embodiment, the pressure pulse purges between 0.5 and 5 milliliters of ink through print head 120. In another embodiment, the pressure pulse purges more than one milliliter of ink through print head 120. In another embodiment, the pressure pulse purges between 1 milliliters and 3 milliliters of ink through print head 120. In another embodiment, the pressure pulse is between one and ten single or individual pressure pulses. In another embodiment, the pressure pulse is between one and five single or individual pressure pulses. On one embodiment, the pressure pulse is only one pressure pulse.

A malfunction error, such as a failure to purge sufficient ink may be caused by one of: (1) a failure of the priming system 126 to provide a sufficient pressure pulse, (2) a failure of priming system 126 to properly engage or interface with cartridge 236 (or cartridge 300), or (3) a failure of print head 126 to be properly positioned relative to priming system 126 to name a few exemplary failure modes. The controller 110 of the present invention is configured to detect malfunction errors that may be one of these failure modes.

Specifically, in one embodiment, a failure of the priming process to sufficiently purge ink through print head 120 can be detected by monitoring temperature drops with the controller 110. For example, if there is zero ink-flux and the temperature drop is less than a no-prime benchmark temperature, a malfunction alert occurs. In other words, if the controller 110 notices that the temperature did not change during the actual priming event, an assumption is made that a malfunction has occurred during the priming event.

In another embodiment, an improper seal between the priming system 126 and a portion of a print cartridge and a severely clogged print head 120 that cannot be primed can be detected. In these particular cases, the system can use two signals that are coupled together. An improper seal or clogged head error can be detected by the controller 110 if a lack of temperature reduction occurs after a prime request that has a higher pressure drop when providing the air to drive the priming event is identified in the priming system 126. In other words, if a component is not well connected, pressurized air will escape during a priming event, which will alert the controller 110 that a component is not correctly sealed or installed.

Figure 5:
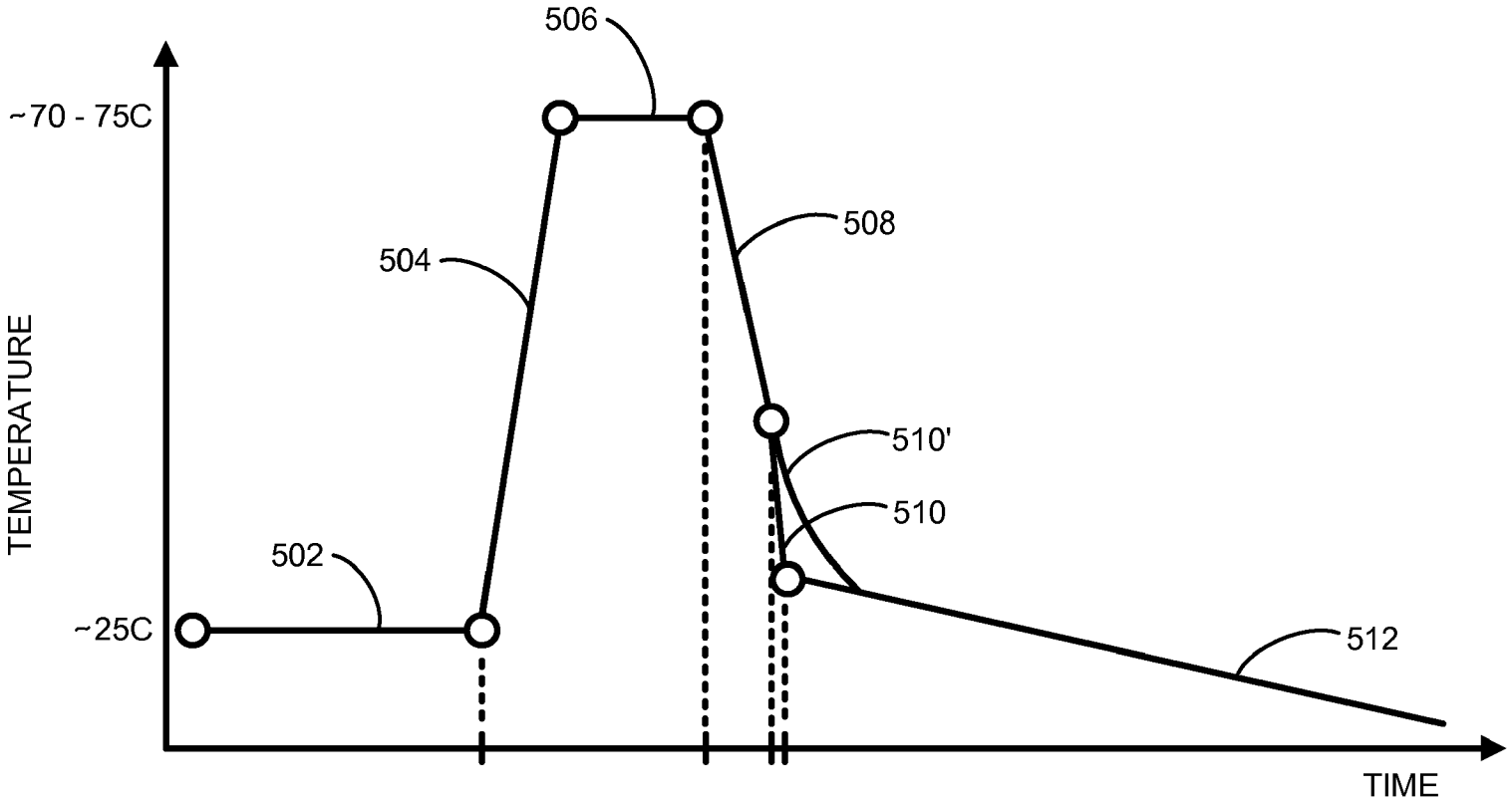
FIG. 5 is a not-to-scale graphical representation intended to illustrate a sequence of events occurring with one embodiment of the present invention.

FIG. 5 is a not-to-scale graphical representation intended to illustrate a sequence of events occurring with one embodiment of the present invention. During a first portion 502 of the graph, the printing system 200 prepares for the prime event. This may include positioning the carriage 236 in service station 230 under control of controller 110. During second portion 504 of the graph, the controller activates warming of print head 120. During this portion 504 of the graph, the temperature of the print head 120 rises rapidly.

During a third portion 506 of the graph, the controller holds or stabilizes the print head temperature. During a fourth portion 508 of the graph, the controller no longer warms the print head but monitors the temperature. During this portion, heat drains from the print head, causing a fall in temperature.

During a fifth portion 510 of the graph, the prime event occurs during which ink is purged through print head 120. As discussed above, this may be one or a plurality of externally applied pressure pulses purging at least 0.5 milliliters of ink through print head 120. In one embodiment, the temperature of print head 120 falls much more rapidly during fifth portion because the ink flow through print head 120 convectively cools print head 120. Thus, the activation of the pressure pulse acts to reduce the temperature print head 120.

The controller 110 makes a comparison of a rate of change or a total change in temperature during segments 508 and 510 to ascertain whether a proper fluid purge of print head 120 has taken place during segment 510. In one embodiment, the controller 110 computes a temperature change during a 400 millisecond portion of segment 508 (no prime cooling) and a temperature change of a 400 millisecond portion of segment 510 (during prime event) in order to verify that a proper prime event has occurred.

In one embodiment, the priming event causes the print head 120 to cool at least 10 degrees Celsius more than the cooling would have been without a priming event. Controller 110 monitors the temperature of print head 120 and thereby determines whether or not a proper priming event has taken place.

During segment 512, the priming event has ceased. As can be seen, the temperature now decreases at a much slower rate than that which takes place during the priming event since convective cooling is no longer a factor.

As a simplified illustrative example, in one embodiment, a stabilized temperature (segment 506) is about 85 degrees Celsius. During a 500 millisecond priming event (segment 510), about 2 milliliters of ink can pass through print head 120. During the priming event, the temperature of print head drops by about 25 degrees Celsius. If the priming event does not take place during segment 510, then the temperature of print head will decrease by about 8 degrees Celsius in this example during segment 510', and controller 110 will be able to generate an error signal. This example is not intended to be limiting, but to illustrate a sample operation of one embodiment of the present invention.

The foregoing has described the principles, embodiments and modes of operation of the present invention. However, the invention should not be construed as being limited to the particular embodiments discussed. The above described embodiments should be regarded as illustrative rather than restrictive, and it should be appreciated that variations may be made in those embodiments by workers skilled in the art without departing from the scope of the present invention as defined by the following claims.

What is claimed is:

1. A method of verifying that a proper maintenance priming operation has been performed on a print head comprising:

applying a fluid prime pressure external to the print head to purge the print head with fluid wherein purging the print head with fluid has an effect of reducing the print head temperature;

monitoring a temperature change in the print head that results from purging the print head with fluid; and analyzing the temperature change to verify that a sufficient volume of fluid has passed through the print head while the fluid prime pressure is applied.

2. The method of claim 1 wherein the print head has a plurality of nozzles and wherein applying the fluid prime pressure includes applying a pressure pulse that purges at least 0.5 milliliters of ink through the plurality of nozzles and wherein the pressure pulse is one of: (1) a vacuum pulse or (2) a positive pressure pulse.

3. The method of claim 1 wherein prior to applying the fluid prime pressure the method further comprises:

positioning the print head proximate to a priming system; and coupling the priming system to the print head, wherein applying the fluid prime pressure is performed by the priming system.

4. The method of claim 1 further comprising warming the print head to an elevated temperature and wherein monitoring the temperature change in the print head occurs while the print head cools to a reduced temperature that is less than the elevated temperature and wherein analyzing the temperature change includes determining a temperature change between the elevated temperature change and the reduced temperature.

5. The method of claim 1 wherein analyzing the temperature change includes determining a rate change of a temperature of the print head.

6. The method of claim 1 wherein monitoring the temperature change in the print head occurs while purging the print head with fluid.

7. A printing system comprising:

a print head including a temperature sensor;

a priming system configured to apply a fluid pressure externally to the print head to purge the print head with fluid, wherein purging the print head with fluid has an effect of reducing the print head temperature; and a controller configured to: (1) activate the priming system thereby purging the printhead with fluid, (2) monitor a signal from the temperature sensor and (3) determine whether activating the primer has resulted in sufficient fluid passing through the print head based upon monitoring the signal from the temperature sensor.

8. The printing system of claim 7 wherein the print head includes a self-warming system and wherein the controller is configured to activate the self-warming system to raise the temperature of the print head to an elevated temperature just prior to activating the priming system to wherein an analysis of the signal from the temperature sensor enhances the determination of whether the primer has provided a sufficient fluid purge.

9. The printing system of claim 7 further comprising identifying whether a failure in the primer has occurred wherein the failure is one of: (1) a malfunction of the priming system, (2) an improper seal between the priming system and a portion of a print cartridge incorporating the print head, (3) a severely clogged print head that cannot be primed.

10. The printing system of claim 7 wherein the controller is configured to monitor a calibration signal from the temperature sensor when a fluid purge does not occur and wherein the controller is configured to compare the calibration signal with the signal from the temperature sensor that results from activating the priming system.

11. The printing system of claim 7 wherein the controller is configured to monitor the signal simultaneously while activating the priming system.

12. The printing system of claim 7 wherein the controller is further configured to transport the print head into proximity with the priming system before activating the priming system.

13. A non-transitory computer readable medium configured to execute instructions on a controller for verifying proper operation of a maintenance priming operation on a print head, the instructions causing the following steps to occur, comprising:

warming the print head to a test elevated temperature;

applying a fluid pressure source external to the print head;

receiving a test signal indicative of a temperature of the print head as it cools from the test elevated temperature; and analyzing the test signal and thereby determining whether the pressure source purged sufficient fluid through the print head.

14. The computer readable medium of 13 further comprising:

warming the print head to a calibration elevated temperature;

receiving a calibration signal indicative of a temperature of the print head as it cools from the calibration elevated temperature; and wherein analyzing the test signal includes analyzing the calibration signal.

15. The computer readable medium of claim 14 wherein receiving the calibration signal occurs before receiving the test signal.

* * * * *

UNITED STATES PATENT AND TRADEMARK OFFICE

CERTIFICATE OF CORRECTION

PATENT NO. : 8,356,877 B2
APPLICATION NO. : 13/055739
DATED : January 22, 2013
INVENTOR(S) : Hector Jose Lebron et al.

It is certified that error appears in the above-identified patent and that said Letters Patent is hereby corrected as shown below:

In the Claims

In column 10, line 9, in Claim 14, delete "13" and insert -- claim 13 --, therefor.

Signed and Sealed this
Twenty-third Day of April, 2013

Teresa Stanek Rea

Teresa Stanek Rea
*Acting Director of the United States Patent and Trademark Office*